United States Patent [19]

Wappler

[11] 4,272,932

[45] Jun. 16, 1981

[54] TELESCOPIC BOOM

[76] Inventor: Joachim H. R. Wappler, 317 Kenollie Rd., Mississauga, Ontario, Canada

[21] Appl. No.: 906,661

[22] Filed: May 16, 1978

[51] Int. Cl.[3] ..... E04H 12/34

[52] U.S. Cl. ..... 52/118; 212/267; 52/632

[58] Field of Search ..... 52/117, 118, 731, 115, 52/632; 212/55

[56] References Cited

U.S. PATENT DOCUMENTS

| | | | |
|---|---|---|---|
| 3,129,821 | 4/1964 | Graham et al. | 212/55 |
| 3,307,713 | 3/1967 | Bopp | 212/55 |
| 3,516,553 | 6/1970 | Reske | 52/118 X |

*Primary Examiner*—Carl D. Friedman

*Attorney, Agent, or Firm*—George A. Rolston; William F. Frank

[57] ABSTRACT

An improved telescopic boom for a truck mounted hoist in which at least the middle telescoping section of the boom is fabricated from I-section structural steel having a central web, and upper and lower flanges, the flanges having inwardly facing surfaces lying in angled planes which are not normal to the plane of the web, and in which the trolley and fixed portion of the boom are fabricated of any other suitable structural material, and having at least two sets of identical rimmed wheels, one set mounted directly on the fixed section, and the other set mounted directly on the trolley, without the use of tilting arms, the two sets of wheels riding in opposite sides of the I-section material of the telescopic intermediate section, with the tread of the wheels carrying the load and with the rims providing lateral guidance thereby dispensing both with the mounting arms and with the lateral guide rollers.

3 Claims, 5 Drawing Figures

FIG 3
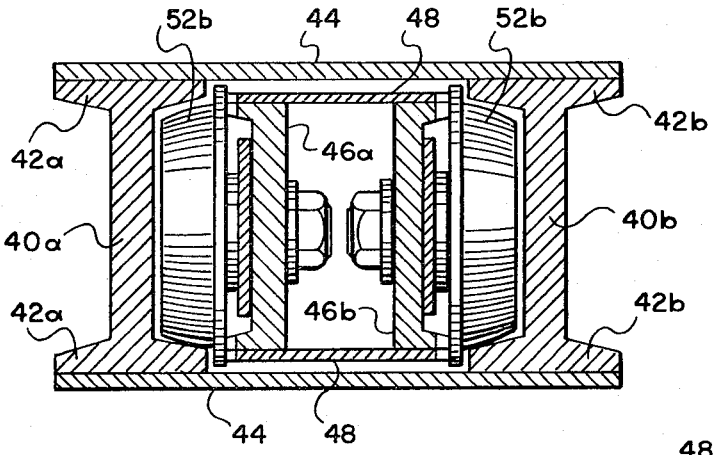
FIG 4
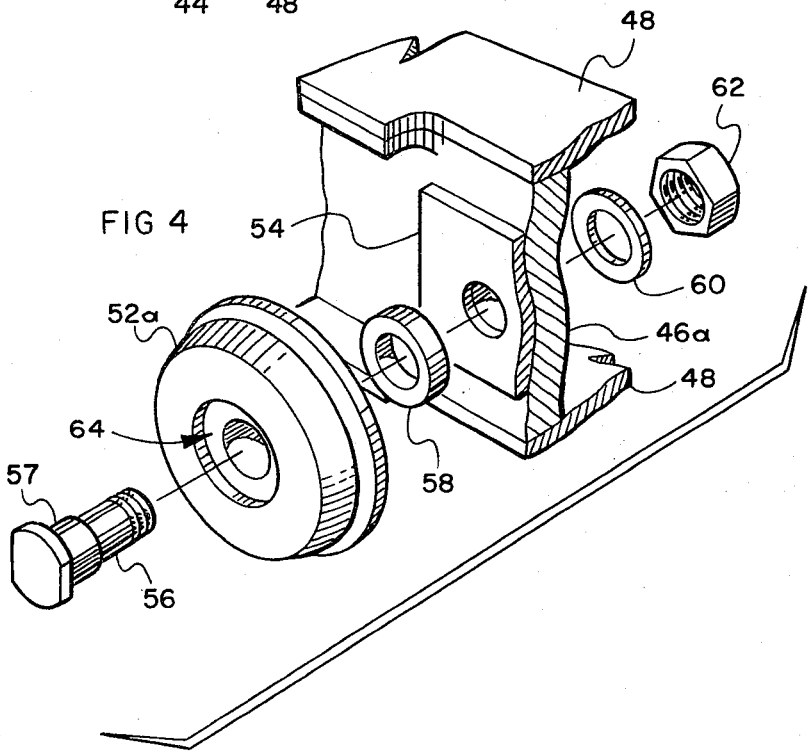
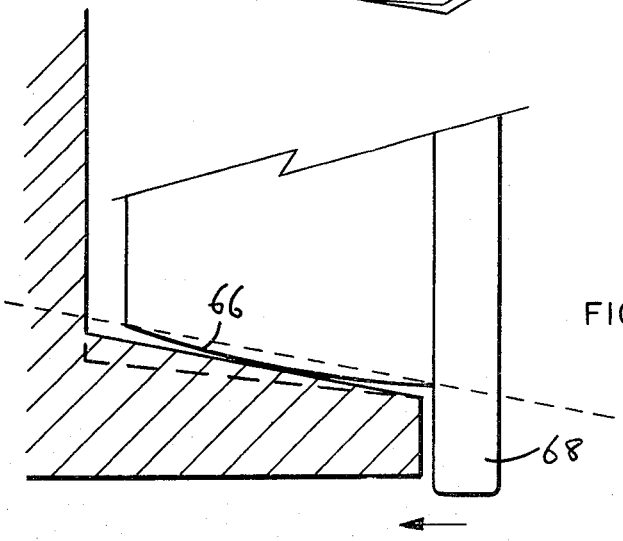
FIG 5

TELESCOPIC BOOM

The invention relates to a telescopic boom for a hoist such as a truck mounted hoist.

Truck mounted hoists employing telescopic booms have been well known, and are described for example in U.S. Pat. No. 3,307,713. When making such booms, it was customary to fabricate them out of load bearing structural steel beams in the form of a C section. Such beams have a central web and two side flanges.

Such C section structural members were arranged back to back, or face to face, and joined by transverse steel webbing welded there along.

Structural steel members such as C-section members cause certain problems. Their tolerances are relatively slack, and variations in angles, and dimensions are quite extensive. Consequently the steel rollers acting as bearings between the various sections had to accomadate such variations.

For this reason, in order to telescope the various sections one within the other, it was customary to employ steel rollers, mounted in pairs on swingable mounting arms.

In this way as the sections telescoped one within the other, irregularities in the steel members, and also deflection caused by loads at the end of the boom, could be accommodated by tilting movements of the mounting arms allowing the two rollers mounted thereon to swing.

This form of construction works satisfactorily. It is however a costly and time consuming way of solving the various problems. In particular, it requires the precision machining of a large number of parts which must be then fitted together to function in the manner described.

In addition, a more serious disadvantage was the fact that the structural steel C-section members are required in various different sizes to accommodate the different loads. The spacing between the upper and lower flanges of such a C shaped member will vary depending upon its load bearing characteristics. The diameter of the wheels or rollers required to provide a telescoping boom in various different sizes of C-section will thus have to be made in various sizes to accommodate such different sizes of structural material.

Thus in a three-part boom there would normally be three different sizes of C-section material. This would mean that two different sizes of rollers must be used.

In a three part telescoping boom there is a fixed section, a telescoping section, and an end trolley extendable from the telescopic section. In order to provide sufficient load carrying capacity at the free end of the boom i.e. the trolley, the requirement for the structural steel for that member imposes a certain dimensional limitation. Given that limitation it is then necessary that the middle, i.e. telescopic, section is large enough to accommodate the trolley within it. In turn it is then necessary that the fixed section is even larger so that it to can accommodate the middle or telescoping section. The end result is that the size of structural steel used for the fixed end section may very well become much greater than is necessary, in order to permit successive reductions in size between the middle and the free end or trolley section. Excessive steel is used, leading to the production of an over weight hoist. This both reduces the load carrying capacity of the truck or other vehicle, and also increases the expense of the hoist.

Clearly, if a different form of structural material can be used having greater load bearing capabilities in smaller sizes, then a much smaller hoist can be fabricated, capable of carrying equivalent loads. An example of such a stronger structural material is an I-beam. This type of beam is capable of carrying greater loads than a C-section beam. However the I-section beam has usually been thought to be impractical, for a telescopic hoist since it is extremely difficult to attach suitable rollers, mounted on tilting brackets due to the two flanges which extend on both sides of the web.

I-beams also exhibit relatively great variations in dimensions and angles which have been a further deterrent factor against their use in the past.

In addition, in conventional hoists, it is also necessary to mount smaller lateral guide rollers, for guiding the telescopic sections on either side. While the use of such lateral guide rollers presented no real difficulty in connection with C-section beams, the use of such lateral guide rollers on I-section beams presented more difficult problems.

BRIEF SUMMARY OF THE INVENTION

The invention comprises an improved telescopic boom for a truck mounted hoist in which at least the middle telescoping section of the boom is fabricated from I-section structural steel having a central web, and upper and lower flanges, the flanges having inwardly facing surfaces lying in angled planes which are not normal to the plane of the web, and in which the trolley and fixed portion of the boom are fabricated of any other suitable structural material, and having at least two sets of identical rimmed wheels, one set mounted directly on the fixed section, and the other set mounted directly on the trolley, without the use of tilting arms, the two sets of wheels riding in opposite sides of the I-section material of the telescopic intermediate section, with the tread of the wheels carrying the load and with the rims providing lateral guidance thereby dispensing both with the mounting arms and with the lateral guide rollers.

The invention further comprises bearing wheels having a convexly curved wearing surface or tread set at an angle so that they may seek their own location on the surface of the I-section flanges, over a wide range of tolerances.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

FIG. 3 is a section along the line of 3—3 of FIG. 1;

FIG. 4 is an exploded isometric view showing the assembly of the bearing wheel according to the invention, and, FIG. 5 shows the engagement of the bearing wheel on the I-section flange.

FIG. 1 shows a truck mounted hoist, according to the invention, in a more or less fully extended position, the truck or other vehicle being omitted for the sake of clarity.

Figure 1:
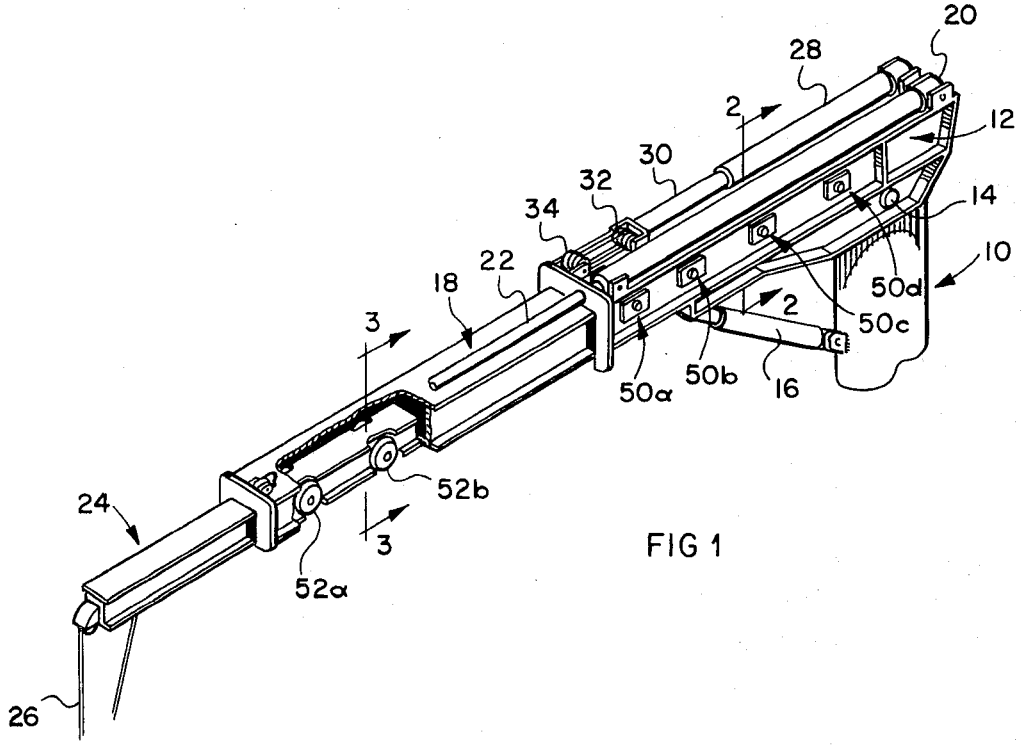
FIG. 1 is a perspective illustration of a truck mounted hoist according to the invention.

The hoist will be seen to comprise a generally vertical column 10, only a portion of which is shown, and which is mounted at its base by any suitable means on or adjacent to the bed of a vehicle. The details of the column 10 itself are irrelevant for the purposes of the present invention, and may vary widely.

A fixed boom section 12 is mounted on top of the column 10. The boom section 12 is swingable upwardly and downwardly in a vertical plane, about the pivot point 14, by any suitable power operated means such as the cylinder 16. The term "fixed" when used in association with the boom section 12 is not therefore intended to exclude such vertical swinging action, but merely, indicates that the boom section 12 does not extend or retract relative to the column 10. The details of the controls relating to the cylinder 16 are well known in the art, and require no further description.

An intermediate or so-called telescoping section 18 is slidably received within the main section 12, and may be extended therefrom and retracted thereinto. Any suitable power operated means is provided for such extension and retraction, for example in the form of power cylinder 20, and operating rod 22, the cylinder 20 being mounted on top of the fixed section 12, and the free end of the operating rod 22 being connected to the telescoping section 18.

A trolley section 24 is telescopically received within the intermediate telescopic section 18, and is extendable therefrom and retractable thereinto, by means of the hoisting cable 26. The arrangement of the hoisting cable 26 is essentially the same as that shown in for example U.S. Pat. No. 3,307,713, and is in any event well known in the art and requires no further description. The hoisting cable 26 is raised and lowered by means of for example the power cylinder 28, and operating rod 30. The operating rod 30 is provided at its free end with a group of sheaves 32, and a further group of fixed sheaves 34 is mounted on the end of the fixed section 12. The cable 26 runs around the sheaves 32 and 34, so that it may be raised and lowered by means of the cylinder 28.

The cable 26 runs around a series of further guide sheaves (not shown) within the various sections 12, 18 and 24 of the boom, in the manner described in the aforesaid U.S. Letters Patent.

In order to extend the trolley section 24 relative to the intermediate telescopic section 18, there is provided a further cable system (not shown) within the various sections of the boom, and running around various sheaves mounted on the interior of the telescopic section 18, and the ends of which are fixed within the fixed section 12.

This system of cables is described in the aforesaid U.S. Pat. No. 3,307,713.

When the telescopic section 18 is extended out of fixed section 12 by means of the cylinder 20, such operating cable forces a corresponding simultaneous extension of the trolley 24 out of the telescopic section 18. Movement in the reverse direction of the telescopic section 18 also causes traction of the trolley 24.

Figure 2:
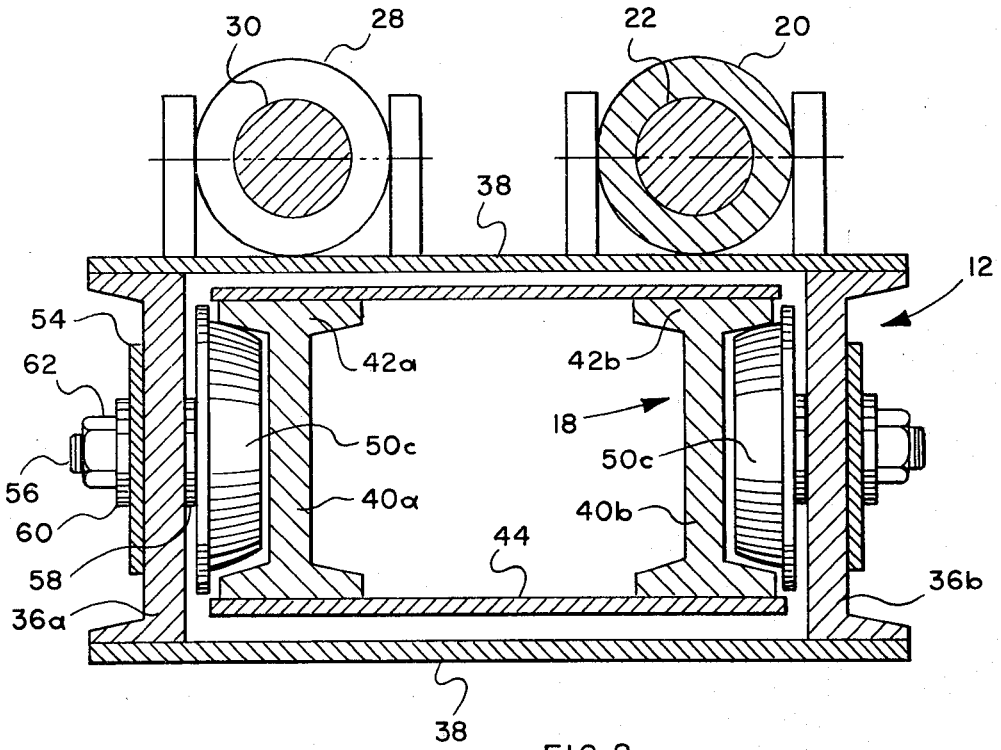
FIG. 2 is a section along the line of 2—2 of FIG. 1.

Referring now to FIGS. 2, 3, 4 and 5, it will be noted from FIG. 2 that the fixed boom section 12 is built up of two, right and left-hand lengths **36*a*, 36*b*, of C-section structural steel, located in parallel spaced apart location, and joined by horizontal steel webs 38, welded to the upper and lower surfaces of the C-section material. The telescopic intermediate section 18 will be seen to be made up of two lengths 40*a* and 40*b* of I-section structural steel material, having upper and lower flanges 42*a* and 42*b* extending on either side thereof. Horizontal upper and lower webs 44 are welded to the upper and lower surfaces of the I-section members 40*a* and 40*b***, securing them in parallel spaced apart relation as shown.

As shown in FIG. 3, the trolley section 24 of the boom is composed of two lengths **46*a* and 46*b* of C-section structural steel material, mounted in spaced apart parallel relation, and joined together by means of horizontal upper and lower webs 48** welded to the upper and lower surfaces thereof.

In order to provide bearing surfaces between the fixed section 12, and the telescopic section 18, and also between the trolley section 24 and the telescopic section 18, there are provided respective outer and inner sets of rimmed bearing wheels **50*a*, 50*b*, 50*c* and 50*d*, and 52*a* and 52*b*** respectively.

As shown in FIG. 2 and FIG. 3, the bearing wheels 50 and 52 are of identical size and construction, and bearing wheels 50 are attached to the inwardly directed faces of the C-section members **36*a* and 36*b* of the fixed section 12, whereas the bearing wheels 52*a*, 52*b* are attached to the outwardly directed faces of the C-section members 46*a*, 46*b* of the trolley section 24**.

In this way the bearing wheels 50 and 52 engage in the space between the upper and lower flanges **42*a* and 42*b* of the I-sectioln members 40*a* and 40*b* of the telescopic section 18**.

The wheels 50 and 52 are mounted in essentially the same way as shown in FIG. 4. A reinforcing plate 54 is welded to the C-section member, either member 36 or member 46, and a bolt 56 passes through the wheel 50 or 52, and then passes through a spacer washer 50, and then through the C-section member and is then fastened by means of a washer 60 and nut 62.

The wheel 50 or 52 is provided with a well 64 for receiving the head of the bolt 56, so that it will not obstruct the engagement of the wheel 50 or 52 in the I-section members **40*a* and 40*b***.

It will also be noted from FIG. 4 that the bolt 56 has a shoulder 57 formed thereon adjacent the head, which is the same depth as the thickness of the wheel 50 or 52 in the region of the well 64. In this way, the bolt 56 can be tightened up, while still permitting the wheel 50 or 52 to rotate freely thereon.

With particular reference to FIG. 5, it will be noted that the wheel members 50 and 52 are required to engage the surfaces of the flanges **42*a* and 42*b*, and that such surfaces are not normal to the plane of the webs 40*a* and 40*b***, but in fact form an obtuse angle thereto.

It will further be noted that due to the inherent nature of the construction of Ib members, the angling of the surfaces does not remain constant but is subject to relatively wide variations.

In order to overcome the problems created, by such variation, the wheels 50 and 52 are all provided with a tread surface 66 which tapers generally from its widest point at about the rim 68, and is provided with a convexially curved contour.

In this way, the treads of the wheels will be able to run up or down the slope of the flanges, and will be essentially self guiding as the various boom sections telescope relative to one another. Any extreme movement will be controlled by means of such rims 68 engaging on the edge of the flanges.

In this way, it is no longer necessary to provide the relatively complex arrangement of bearings as it used in the past. It is particularly advantageous that wheels 50 and 52 are of identical size, both on the fixed boom section 12 and also on the trolley section 24. It will be understood that no wheels at all are provided on telescopic section 18.

The invention therefore achieves a major reduction in the number of separate parts and also in the time spent in assembly and permits the use of a lighter boom while achieving the same load carrying capacity.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A telescopic boom for a hoist such as a truck mounted hoist or the like, having a column portion, a fixed boom section mounted on said column portion, a telescopic boom section slidably received within said fixed section, a trolley section slidably received within said telescopic section, wherein the improvement comprises:

two parallel I beam members fastened together in side by side relationship and forming said telescopic section, each of said I beam members comprising a central web portion and upper and lower flanges extending outwardly therefrom on either side of said web portion, and said flanges having generally planar surfaces thereon lying in a plane at an obtuse angle relative to the plane of said web portion;

wheel members mounted in an inwardly facing manner on said fixed boom section, and engaging opposite said I beam members on their outwardly directed sides, and further wheel members on said trolley section, facing outwardly with respect to and engaging said I beam members on their inwardly directed sides;

rims on said wheel members engageable with said I beam members for guiding telescoping movement, and, tapering, convexly curved tread surfaces on said wheel members engaging said generally planar surfaces of said flanges in an essentially tangential manner.

2. A telescopic boom is claimed in claim 1 wherein said fixed boom section is made of two side by side parallel C-section beam members, having a web and two flanges thereon extending on one side of said web only, said beam members being arranged with their flanges extending outwardly, and said wheel members being mounted on said web, on the opposite side of said flanges, and wherein said C-section beam members, in section, have a height dimension greater than that of said I beam members.

3. A telescopic boom as claimed in claim 2 wherein said trolley section is formed of two side by side C-section beam members, having a web and two flanges extending on one side only thereof, and wherein said two lengths of C-section beam members are arranged with their flanges extending outwardly, and fastening means extending therebetween, said flanges being cut away at intervals to provide spaces therein, and said further wheel members being mounted on said web in said spaces, and extending outwardly from said C-section beam members into engagement with said generally planar surfaces of said flanges ofsaid I beam members, said wheel members on said fixed boom section and said wheel members on said trolley section being all of the same diameter and tread configuration.

* * * * *